US006059566A

United States Patent [19]

Cummings, III

[11] Patent Number: 6,059,566

[45] Date of Patent: May 9, 2000

[54] BURNER APPARATUS

[75] Inventor: William G. Cummings, III, Muncie, Ind.

[73] Assignee: Maxon Corporation, Muncie, Ind.

[21] Appl. No.: 09/122,296

[22] Filed: Jul. 24, 1998

Related U.S. Application Data

[60] Provisional application No. 60/053,736, Jul. 25, 1997.

[51] Int. Cl.[7] ..... F23D 14/06; F23D 14/48; F23D 14/62; F23D 14/70

[52] U.S. Cl. ..... 431/353; 431/8; 431/9; 431/12; 431/266; 431/265; 431/350; 239/434

[58] Field of Search ..... 431/12, 8, 9, 265, 431/266, 249, 350, 353, 263, 357, 348; 239/419, 424.5, 425, 426, 431, 434; 60/737

[56] References Cited

U.S. PATENT DOCUMENTS

| | | |
|---|---|---|
| 1,425,343 | 8/1922 | Schumann . |
| 1,771,875 | 7/1930 | Cowardin et al. . |
| 1,960,609 | 5/1934 | Werner . |
| 2,192,996 | 3/1940 | Fenzl . |
| 2,276,131 | 3/1942 | Wiant . |
| 2,667,216 | 1/1954 | Zink et al. . |
| 3,511,589 | 5/1970 | Rothhaar et al. . |
| 3,570,471 | 3/1971 | Lazaridis . |
| 4,155,700 | 5/1979 | Babington . |
| 4,340,180 | 7/1982 | Belknap et al. . |
| 4,379,689 | 4/1983 | Morck, Jr. . |
| 4,403,947 | 9/1983 | Spielman . |
| 4,412,496 | 11/1983 | Trozzi . |
| 4,486,207 | 12/1984 | Baillie . |
| 4,511,379 | 4/1985 | Hauptmann . |
| 4,598,553 | 7/1986 | Saito et al. . |
| 4,681,532 | 7/1987 | Chung . |
| 4,828,487 | 5/1989 | Earl . |
| 4,963,089 | 10/1990 | Spielman . |
| 5,057,008 | 10/1991 | Dielissen . |
| 5,236,350 | 8/1993 | Cummings et al. . |
| 5,399,085 | 3/1995 | Taylor . |
| 5,513,981 | 5/1996 | Harbeck et al. . |
| 5,662,467 | 9/1997 | Jones . |

FOREIGN PATENT DOCUMENTS

| | | |
|---|---|---|
| 1134956 | 4/1957 | France . |
| 1243626 | 2/1971 | United Kingdom . |

*Primary Examiner*—Carl D. Price
*Attorney, Agent, or Firm*—Barnes & Thornburg

[57] ABSTRACT

A burner apparatus is provided in accordance with the present invention that includes a case coupled to an air supply and a nozzle positioned to lie in case and coupled to a fuel supply. Nozzle defines at least one air-flow cavity inside case. Nozzle is formed to include a fuel-distribution chamber and at least one fuel-discharge port to communicate fuel from fuel-distribution chamber into air passing from air supply through each air-flow cavity. Fuel) mixes with air in each air-flow cavity to produce a combustible air-and-fuel mixture therein which can be ignited to produce a flame in case.

74 Claims, 10 Drawing Sheets

BURNER APPARATUS

This appliocation claims benefit of provisional application Ser. No. 60/053,736 filed Jul. 25, 1997.

BACKGROUND AND SUMMARY OF THE INVENTION

The present invention relates to burner apparatus, and particularly to industrial burners for mixing air and fuel to produce a combustible air-and-fuel mixture. More particularly, the present invention relates to a burner apparatus having an air-and-fuel mixing nozzle.

Burners are frequently used in industrial environments to provide heat to various processes. For example, burners are used to provide heat to boilers, furnaces, kilns, rotary dryers, fume incinerators, and pollutant-burning afterburners. Many burners are configured to convert air and fuel into a combustible air-and-fuel mixture which is then ignited to produce a flame for providing heat to a process. Many burners employ complex mixing schemes involving multiple parts which are expensive to manufacture, produce high emissions, and/or have low turn-down ratios.

According to the present invention, a burner apparatus includes a case coupled to an air supply and a nozzle positioned to lie in the case and coupled to a fuel supply. The nozzle defines at least one air-flow cavity inside the case. The nozzle is formed to include a fuel-distribution chamber and at least one fuel-discharge port to communicate fuel from the fuel-distribution chamber into air passing from the air supply through each air-flow cavity. The fuel mixes with the air in each air-flow cavity to produce a combustible air-and-fuel mixture therein which can be ignited to produce a flame in the case.

In preferred embodiments, the nozzle includes a body formed to include the fuel-distribution chamber and an annular side wall and eight vanes appended to the annular side wall and arranged to extend radially in directions away from the fuel-distribution chamber. The vanes are circumferentially spaced apart from one another about the annular side wall of the nozzle body and each pair of adjacent vanes is arranged to define an air-flow cavity therebetween.

Three fuel-discharge ports are associated with each air-flow cavity and formed in the annular side wall of the nozzle body to discharge fuel from the fuel-distribution chamber into each air-flow cavity. Air passing through each air-flow cavity mixes with fuel discharged through the fuel-discharge ports to create a combustible air-and-fuel mixture that can be ignited to produce a flame.

A bluff-body flame holder is provided in all but one of the air-flow cavities to give stability to the flame produced by the, burner. An ignitor is mounted in the one air-flow cavity that does not contain a bluff-body flame holder.

Additional features and advantages of the invention will become apparent to those skilled in the art upon consideration of the following detailed description of preferred embodiments of the invention exemplifying the best mode of carrying out the invention as presently perceived.

DETAILED DESCRIPTION OF THE DRAWINGS

Figure 1:
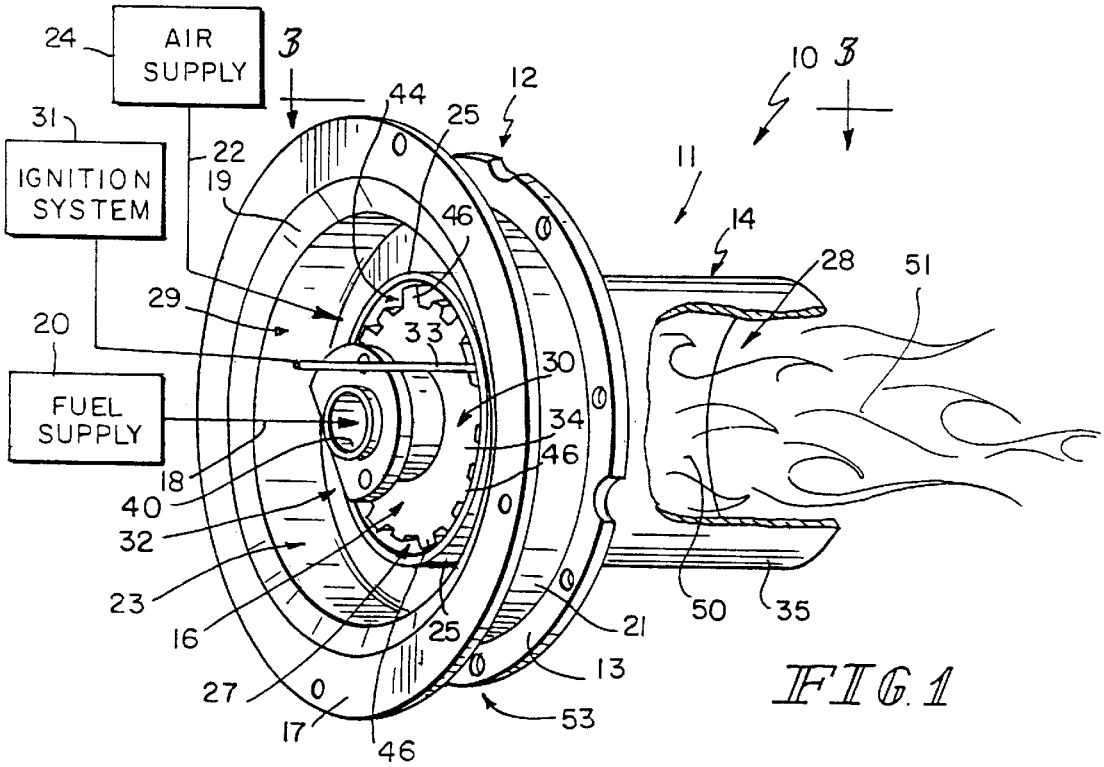
FIG. 1 is a perspective view of a burner apparatus in accordance with the present invention for mixing combustion air from an air supply and fuel from a fuel supply in several regions within the burner apparatus to produce several combustible air-and-fuel mixture streams that are discharged from an air-and-fuel mixing nozzle into a downstream combustion sleeve and ignited to produce a flame.

A nozzle-mixing burner apparatus 10 in accordance with the present invention shown in FIG. 1 produces low exhaust emissions (e.g., carbon monoxide and nitrogen oxide) and has a high "turn-down ratio." Throughout this disclosure, turn-down ratio refers to the ratio of the maximum and minimum "firing rate" for a particular burner apparatus and firing rate is the measure of how much fuel gas is consumed per hour (Btu per hour). For example, at a turn-down ratio of 20:1, twenty times as much fuel gas is fed into the flame at the maximum firing rate than at the minimum firing rate. A high turn-down ratio is particularly beneficial because of the rapid response of the system into which the burner fires.

Figure 2:
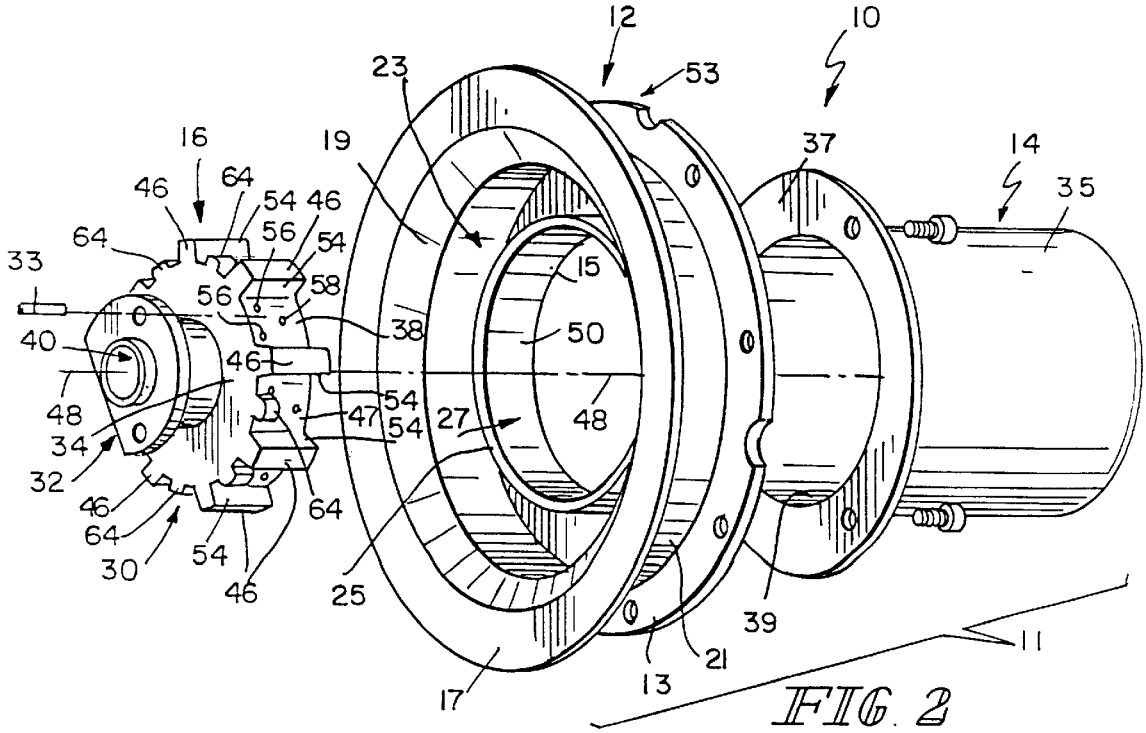
FIG. 2 is an exploded assembly view of the burner apparatus of FIG. 1 showing the burner apparatus including (from left to light) a diagrammatic representation of a spark ignitor, a nozzle, an air plenum for receiving the nozzle therein, and a combustion sleeve for mounting on the air plenum, the nozzle including a hollow body, a plurality of vanes extending radially out from the body, a central file-conducting passageway for conducting fuel from the fuel supply into the body, and a set of three discharge ports between each pair of adjacent vanes for discharging fuel out of the body to mix with air passing through the air plenum and around the nozzle.
Figure 3:
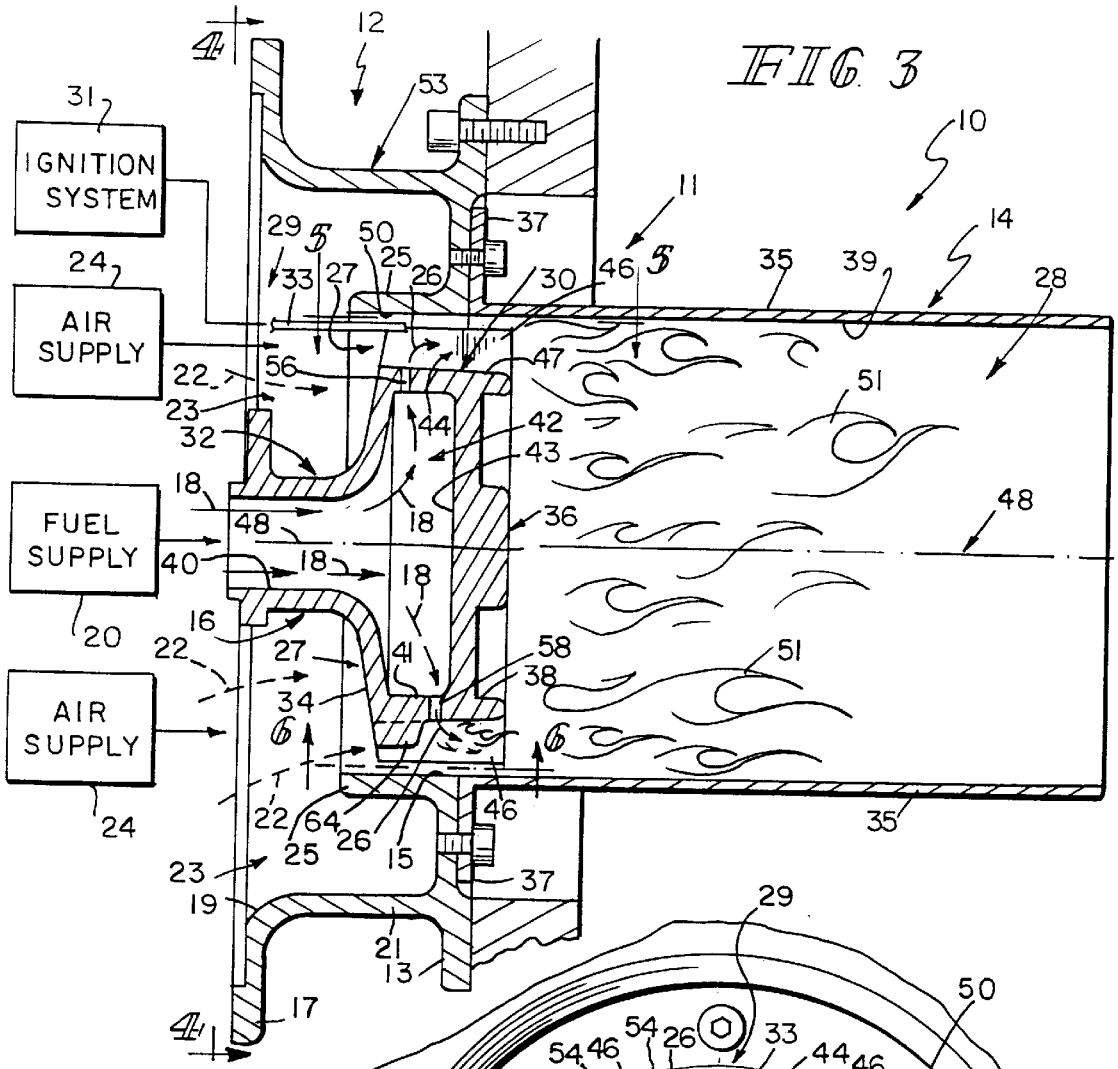
FIG. 3 is a longitudinal sectional view taken along line 3—3 of FIG. 1 showing radial discharge of fuel from the hollow body in the nozzle into streams of combustion air passing through axially extending air-flow cavities defined in the nozzle and between the air plenum and the nozzle.

As shown in FIGS. 1–3, burner apparatus 10 operates to produce a flame 51 and includes a case 11 comprising an air plenum 12 and a combustion sleeve 14 and a nozzle 16 positioned to lie in a passageway formed in case 11. Nozzle 16 premixes fuel 18 from fuel supply 20 and air 22 from air supply 24 in case 11 prior to combustion and discharges several (e.g., eight) combustible air-and-fuel mixtures 26 (from circumferentially spaced-apart points around nozzle 16) into a combustion chamber 28 formed in combustion sleeve 14 and positioned to lie downstream of nozzle 16 as shown, for example, in FIGS. 1–3. Burner apparatus 10 is well-suited for use in applications relating to direct and indirect air heating.

Air plenum 12 includes a front plate 13 formed to include an air outlet aperture 15 coupled to combustion chamber 28, a rear plate 17 formed to include an air inlet 19 coupled to air supply 24, an annular outer wall 21 coupled to front and rear plates 13, 17 as shown, for example, in FIG. 3 to define an interior air transfer region 23 receiving combustion air from air supply 24. Air plenum 12 also includes an annular interior flange 25 positioned to lie in interior air transfer region 23 and appended to front plate 13 at air outlet 15 as shown, for example, in FIG. 3. Front plate 13, annular outer wall 21, and rear plate 17 cooperate to define a shell 53 defining interior air transfer region 23 and containing annular interior flange 25.

Nozzle 16 is positioned to lie in interior air transfer region 23 of air plenum 12 and extend into a nozzle-receiving chamber 27 that is defined by annular interior flange 25. Nozzle-receiving passageway 27 is arranged to conduct air 22 passing through interior region 23 of air plenum 12 into combustion chamber 28 of combustion sleeve 14 through air outlet aperture 15. Air outlet aperture 15 in front plate 13 is positioned to lie at an outlet end of nozzle-receiving passageway 27 as shown, for example, in FIG. 3.

Figure 4:
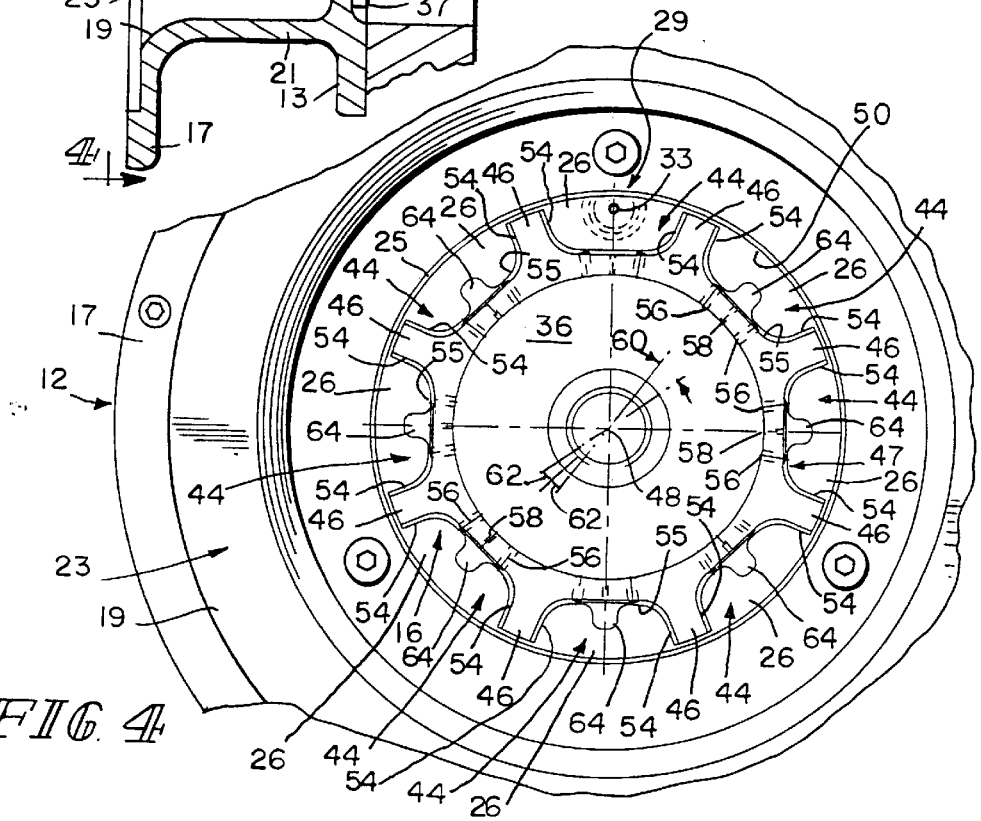
FIG. 4 is a view taken along line 4—4 of FIG. 3 showing a somewhat "D-shaped" air-flow cavity formed between each pair of adjacent vanes and a bluff-body flame holder positioned to lie in seven of the eight air-flow cavities and an ignitor positioned to lie in one of the eight air-flow cavities (e.g., at the "12 o'clock" position in FIG. 4)

An ignitor 29 is positioned to communicate with one of air-and-fuel mixtures 26 as shown, for example, in FIGS. 3 and 4. Ignitor 29 is operable to ignite such an air-and-fuel mixture 26 to produce a flame 51 in combustion chamber 28 as shown in FIGS. 1 and 3. Ignitor 29 includes an ignition system 31 and a spark ignitor 33 coupled to ignition system 31.

Combustion sleeve 14 includes an endless wall 35 formed to include combustion chamber 28 and configured to have, for example, a cylindrical shape. Endless wall 35 includes an interior surface 39. Combustion sleeve 14 also includes an annular mounting flange 37 coupled to endless wall 35 at, for example, one end of endless wall 35. Annular mounting flange 37 is coupled to front plate 13 of air plenum 12 to place interior air transfer region 23 in fluid communication with combustion chamber 28 via the eight air-flow cavities that surround nozzle 16 and lie between interior air transfer region 23 and combustion chamber 28.

Figure 10:
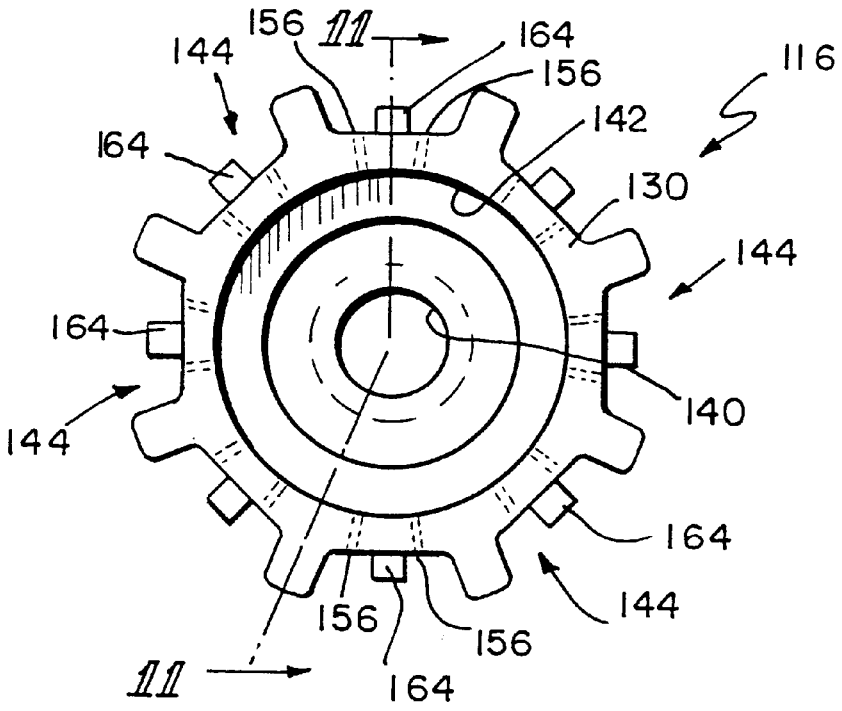
FIG. 10 is a plan view of another embodiment of a nozzle for a burner apparatus in accordance with the present invention.
Figure 11:
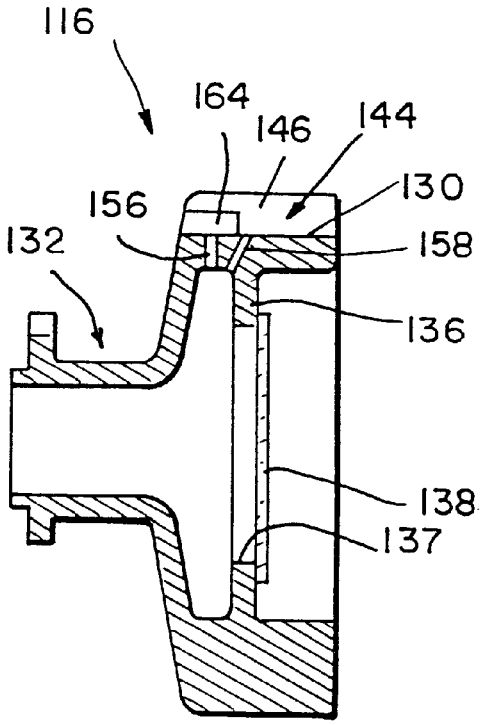
FIG. 11 is a sectional view taken along line 11—11 of FIG. 10.

One embodiment of nozzle 16 is shown, for example, in FIGS. 1–3 and another embodiment of a nozzle is shown in FIGS. 10 and 11. Nozzle 16 includes an annular body 30, an inlet portion 32 coupled to an upstream end 34 of annular body 30, and a closure portion 36 coupled to a downstream end 38 of annular body 30. Inlet portion 32 has a somewhat funnel-like shape as shown in FIG. 1 and is formed to include a fuel-conducting passageway 40 receiving fuel 18 from fuel supply 20. A cylinder-shaped inner wall 41 of annular body 30 and a disk-shaped inner wall 43 of closure portion 36 cooperate as shown, for example, in FIG. 3 to define a fuel-distribution chamber 42 formed in nozzle 16 to receive fuel 18 from fuel supply 20 via fuel-conducting passageway 40.

Nozzle 16 is also formed to include a plurality of air-flow cavities 44 spaced apart from one another about the circumference of annular body 30 and configured to communicate air 22 from air supply 24 into combustion chamber 28 formed in combustion sleeve 14. A plurality of elongated vanes 46 are appended to a somewhat cylinder-shaped outer wall 47 of annular body 30 and arranged to extend radially outwardly from outer wall 47 and in spaced-apart parallel relation to a central axis 48 of nozzle 16. Vanes 46 cooperate to stabilize that portion of flame 51 resulting from combustion of fuel 18 discharged through main fuel-discharge ports 56 and through pilot fuel-discharge ports 58 and air 22 traveling through air-flow cavities 44. Vanes 46 are uniformly, circumferentially spaced apart about the periphery of annular body 30 to form, for example, eight circumferentially spaced-apart air-flow cavities 44. In alternative embodiments (not shown), the circumferential spacing between vanes 46 need not be uniform.

Air plenum 12 and combustion sleeve 14 cooperate to define an outer boundary wall 50, 39 defining an outer boundary of each air-flow cavity 44. Outer wall 47 of nozzle 16 provides a portion of an inner boundary wall that lies in spaced-apart relation to outer boundary wall 50, 39 to define air-flow cavities 44 therebetween. In the illustrated embodiment, portions of inner wall 50 of annular interior flange 25, interior surface 39 of endless wall 39, side walls 54 of vanes 46, and cylinder-shaped outer wall 47 of annular body 30 cooperate to define each air-flow cavity 44 as shown, for example, in FIGS. 1–4.

Fuel 18 from fuel-distribution chamber 42 is discharged into each air-flow cavity 44 to mix with air 22 flowing therethrough to create air-and-fuel mixture 26, which mixture 26 subsequently is discharged into combustion chamber 28 formed in combustion sleeve 14. Fuel 18 is discharged from nozzle 16 in directions that are substantially perpendicular to the direction of air 22 that is flowing through air-flow cavities 44 from air supply 24 to combustion chamber 28, thereby enhancing mixing of fuel and air in burner apparatus 10.

In the illustrated embodiment, two main fuel-discharge ports 56 and one pilot fuel-discharge port 58 are formed in annular body 30 for each air-flow cavity 44 to allow fuel 18 to be dispersed from fuel-distribution chamber 42 into each airflow cavity 44 to mix with air 22 flowing therethrough during operation of burner apparatus 10. Each of ports 56, 58 has an inlet opening formed in cylinder-shaped inner wall 41 of annular body 30 and an outlet opening formed in cylinder-shaped outer wall 47 of annular body 30. Presently, ports 56, 58 are sized and selected to cause about ninety percent of fuel 18 discharged from nozzle 16 to pass through main fuel-discharge ports 56 and about ten percent of fuel 18 discharged from nozzle 16 to pass through pilot fuel-discharge ports 58.

Figure 5:
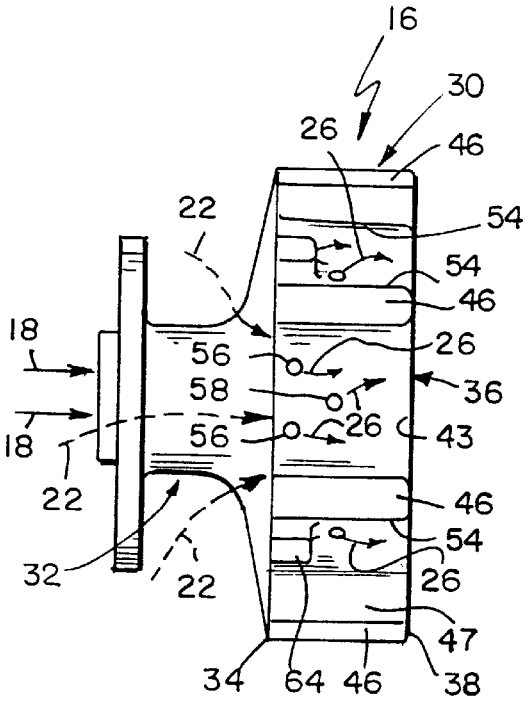
FIG. 5 is a view of the nozzle taken along line 5—5 of FIG. 3 showing the nozzle being formed to include two "upstream" main fuel-discharge ports and one "downstream" pilot fuel-discharge port arranged in a triangular pattern and located in the air-flow cavity that does not contain a bluff-body flame holder.

In a presently preferred embodiment, two main fuel-discharge ports 56 communicating with a common air-flow cavity 44 are circumferentially spaced apart to define an included angle 60 therebetween of about nine degrees (as shown, for example in FIG. 4) and aligned to extend in radially outward directions perpendicular to central axis 48 (as shown in FIG. 3). Main fuel-discharge ports 56 are positioned to lie in close proximity to inlet portion 32 as shown in FIG. 5. Annular body 30 of nozzle 16 is formed to include sixteen main fuel-discharge ports 56 because, in the illustrated embodiment, there are eight air-flow cavities 44 and two main fuel-discharge ports 56 are provided for each air-flow cavity 44.

Figure 6:
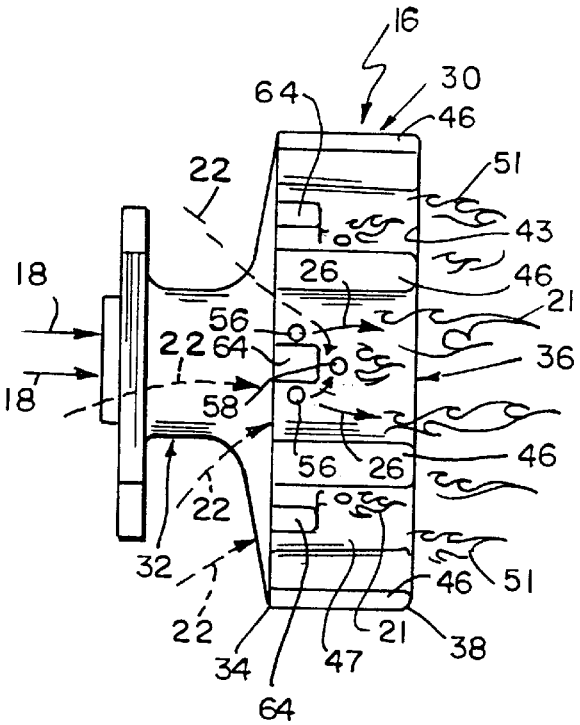
FIG. 6 is a view of the nozzle taken along line 6—6 of FIG. 3 showing the positioning of the two main fuel-discharge ports and the one pilot fuel-discharge port in one of the air-flow cavities containing a bluff-body flame holder relative to the position of the bluff-body flame holder in that air-flow cavity.

Also in a presently preferred embodiment, single pilot fuel-discharge port 58 communicating with a selected air-flow cavity 44 is positioned to lie "between" two companion main fuel-discharge ports 56 communicating with selected air-flow cavity 44 when viewed as shown in FIGS. 2, 5, and 6. Pilot fuel-discharge port 58 is positioned to define an included angle 62 of about four and one-half degrees (as shown, for example, in FIG. 4) between each of companion main fuel-discharge ports 56. Each pilot fuel-discharge port 58 is positioned to lie in close proximity to disk-shaped inner wall 43 of closure portion 36 as shown in FIGS. 3, 5, and 6. Annular body 30 of nozzle 16 is formed to include eight pilot fuel-discharge ports 58 because, in the illustrated embodiment, there are eight air-flow cavities 44 and one pilot fuel-discharge port 58 is provided for each air-flow cavity 44.

A bluff-body flame holder 64 is provided in all but one of air-flow cavities 44 as shown in FIGS. 2, 5 and 6 to give stability to a flame 21 produced by burner apparatus 10. No bluff-body flame holder 64 is provided in one of air-flow cavities 44 as shown in FIGS. 4 and 5 to provide room for a spark ignitor 33 (see FIGS. 1–4) therein. It is within the scope of this disclosure to provide a nozzle 16 without any bluff body flame holders in any of air-flow cavities 44.

Each flame holder 64 is appended to cylinder-shaped outer wall 47 of annular body 30 and positioned to lie about midway between confronting side walls 54 of each air-flow cavity 44. As shown in FIG. 3, flame holder 64 has an upstream end appended to upstream end 34 of annular body 30 and a downstream end terminating just before and on the upstream side of pilot fuel-discharge port 58. The "height" of each flame holder 64 is about fifty percent (50%) of the height of the flanking air-flow cavity side walls 54 on some sizes of burner apparatus 10 (and one hundred percent (100%) for other sizes of burner apparatus 10 and the "length" of each flame holder 64 is about thirty-three percent (33%) of the length of bottom wall 55 of air-flow cavity 44. In the illustrated embodiment, each flame holder 64 is integrally formed as part of annular body 30.

The portion of flame 51 produced by fuel 18 discharged from pilot fuel-discharge ports 58 stabilizes in the wake of bluff-body flame holder 64, as shown, for example, in FIG. 6. The main portion of flame 51 produced by fuel 18 discharged from main fuel-discharge ports 56 stabilizes in wake of vanes 46 and closure portion 36 as shown, for example, in FIGS. 3 and 6.

Figure 7:
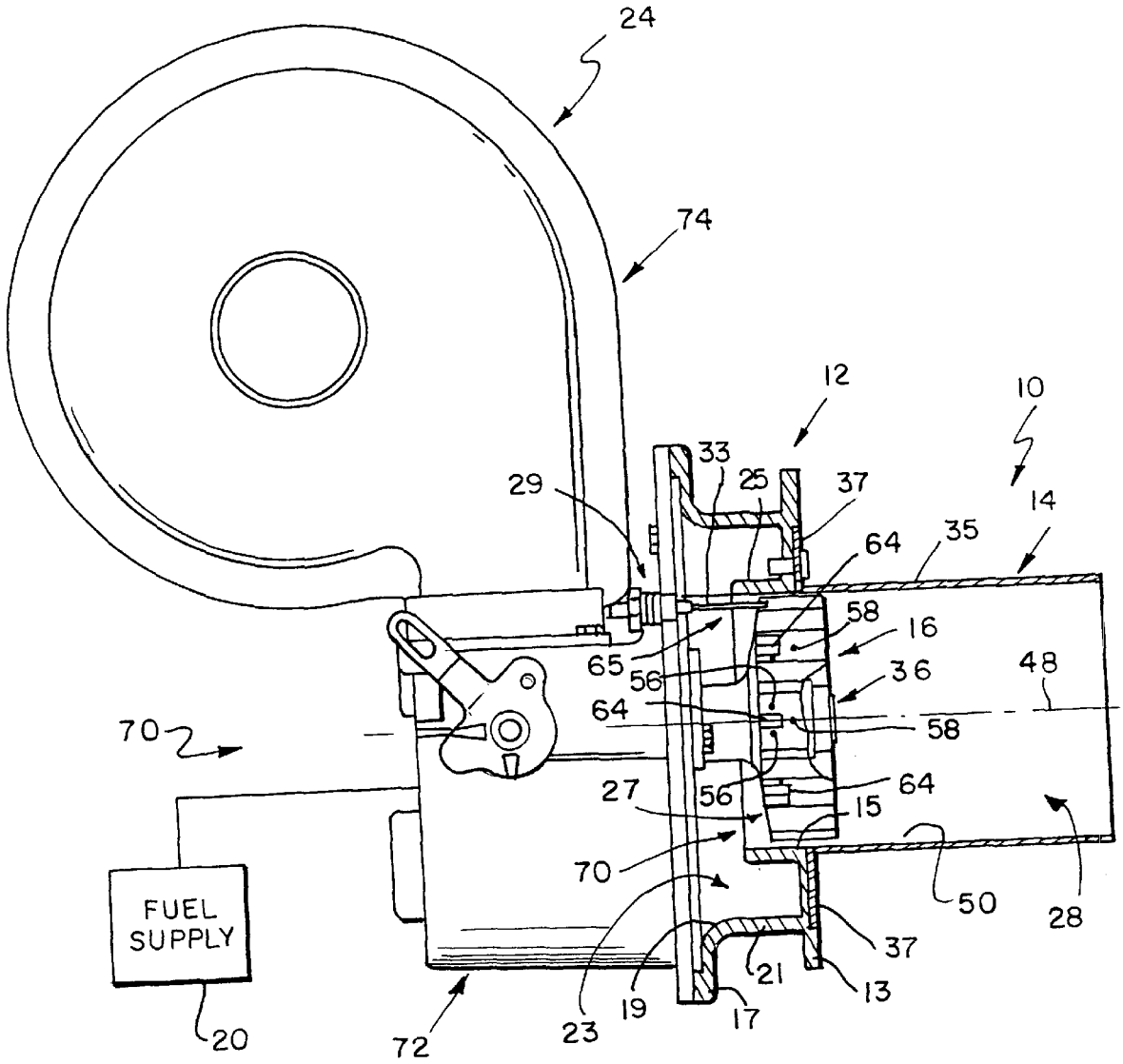
FIG. 7 is a view of a burner apparatus of the type shown in FIGS. 1–4 coupled to air-and-fuel supply apparatus.
Figure 8:
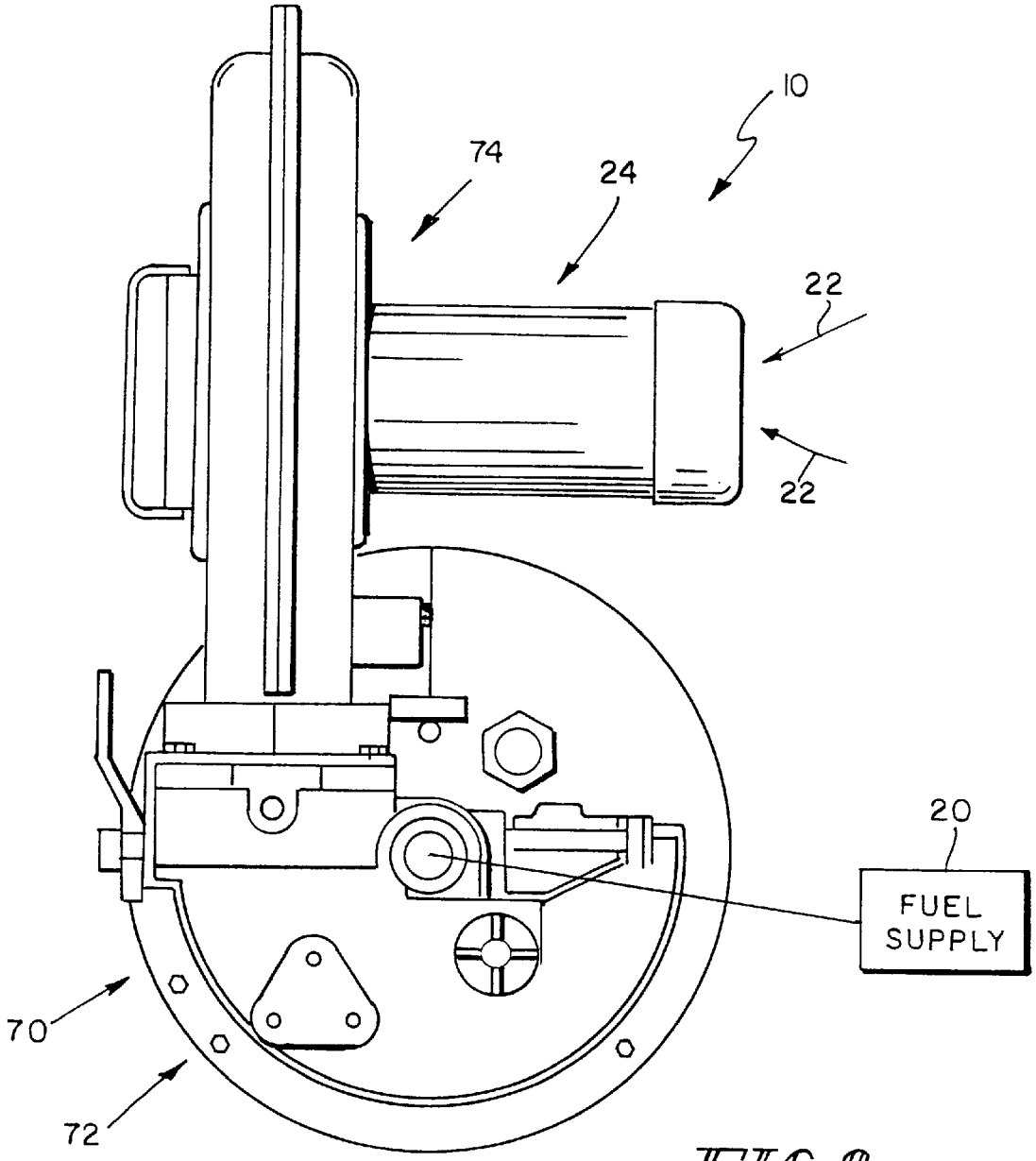
FIG. 8 is a left-side elevation view of the apparatus of FIG. 7.
Figure 9:
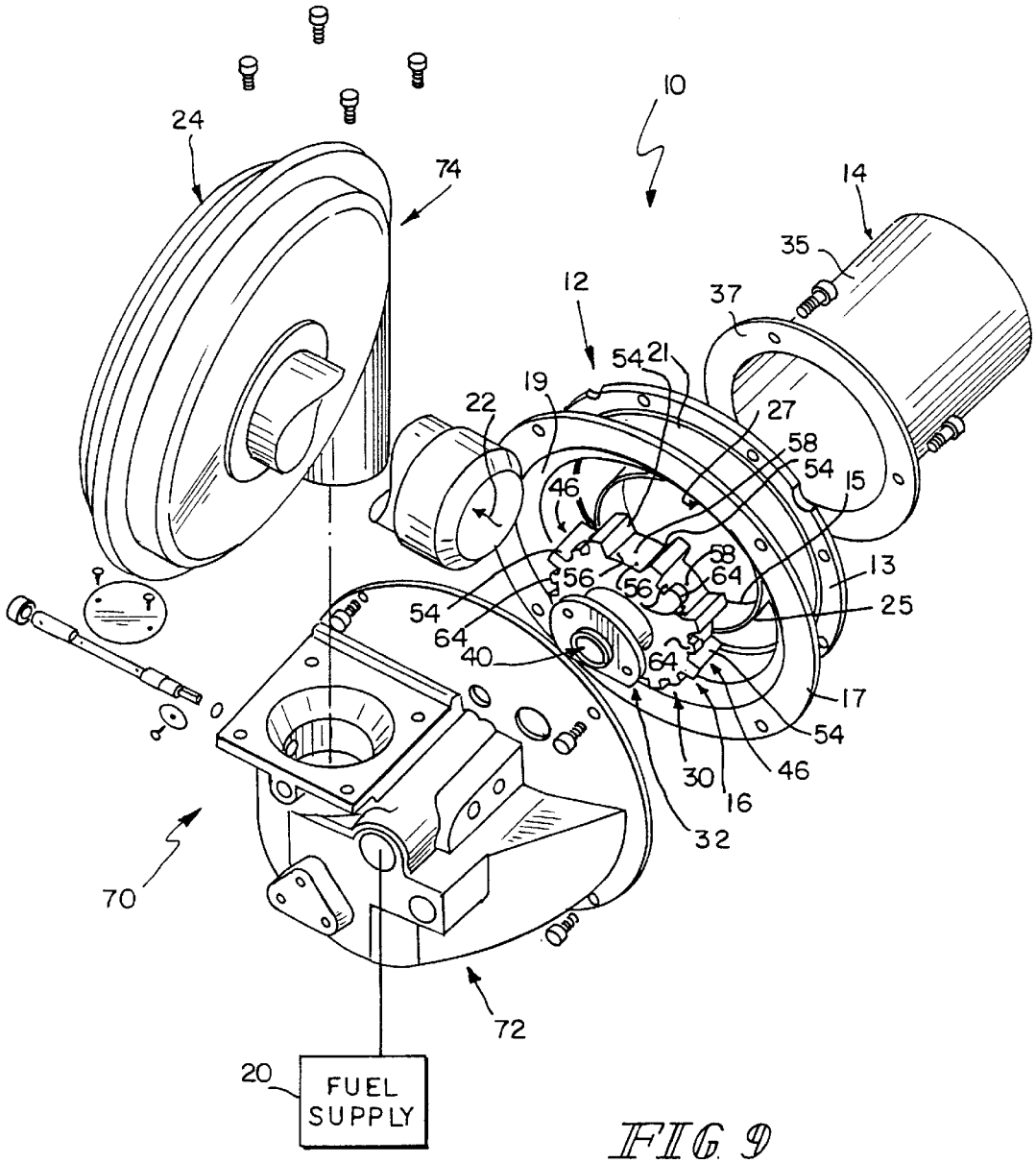
FIG. 9 is an exploded perspective view of the burner apparatus of FIGS. 7 and 8 showing the air plenum, nozzle, and combustion sleeve prior to being assembled and coupled to the air-and-fuel supply apparatus.

An air-and-fuel supply apparatus 70 for use with burner 10 is shown in FIGS. 7–9. As shown best in FIG. 9, air-and-fuel supply apparatus 70 includes an inlet body 72 and a combustion air fan 74 coupled to inlet body 72. Fuel supply 20 is coupled to inlet body 72 and inlet body 72 is coupled to nozzle 16, as shown in FIG. 9, to permit fuel 18 to pass through inlet body 72 and into fuel-conducting passageway 40 of nozzle 16. Combustion air fan 74 is a part of air supply 24. Air plenum 12 is coupled to inlet body 72 so that air 22 from combustion air fan 74 passes into inlet body 72 and into air plenum 12 without mixing with fuel 18. Fuel 18 and air 22 are mixed only after fuel 18 is discharged through fuel-discharge ports 56, 58 in nozzle 16 into air-flow cavities 44 provided in nozzle-receiving (cavity 27 of annular interior flange 25.

Nozzle 16 functions to introduce gaseous fuel 18 into combustion air 22 to produce a combustible air-and-fuel mixture 26. Nozzle 16 is configured to provide a time for air and fuel to mix partially prior to combustion to yield a nearly uniform flame temperature, thereby providing low exhaust emissions. Nozzle 16 is also configured to provide a bluff-body flame holder 64 to give stability to flame 51. The air-and-fuel mixing structure formed in nozzle 16 provides low excess air levels to yield high thermal efficiency and low levels of carbon monoxide, an appropriate air flow at low firing rates to maintain a stable flame and prevent soot formation, and a stable air/fuel ratio over at least a 40:1 turn-down ratio. Low air pressure and low fuel pressure can be used to mix air and fuel in nozzle 16. In an alternative embodiment (not shown), $NO_x$ emissions can be reduced by eliminating bluff-body flame holders 64; however, a lower turn-down ratio will result.

Another embodiment of a nozzle in accordance with the present invention is illustrated in FIGS. 10 and 11. Nozzle 116 includes body 130, inlet portion 132, and closure portion 136 having an opening 137 covered by plate 138. Although plate 138 is illustrated and described, it is understood that a wide variety of blocking mechanisms such as a plug and the like may be used in accordance with the present invention. A fuel-conducting passageway 140 conducts fuel to fuel-distribution chamber 142 for delivery to air-flow cavities 144 defined in part by vanes 146 via main fuel-discharge ports 156 and pilot fuel-discharge ports 158. Bluff-body flame holders 164 are provided in each of eight air-flow cavities 144.

Figure 12:
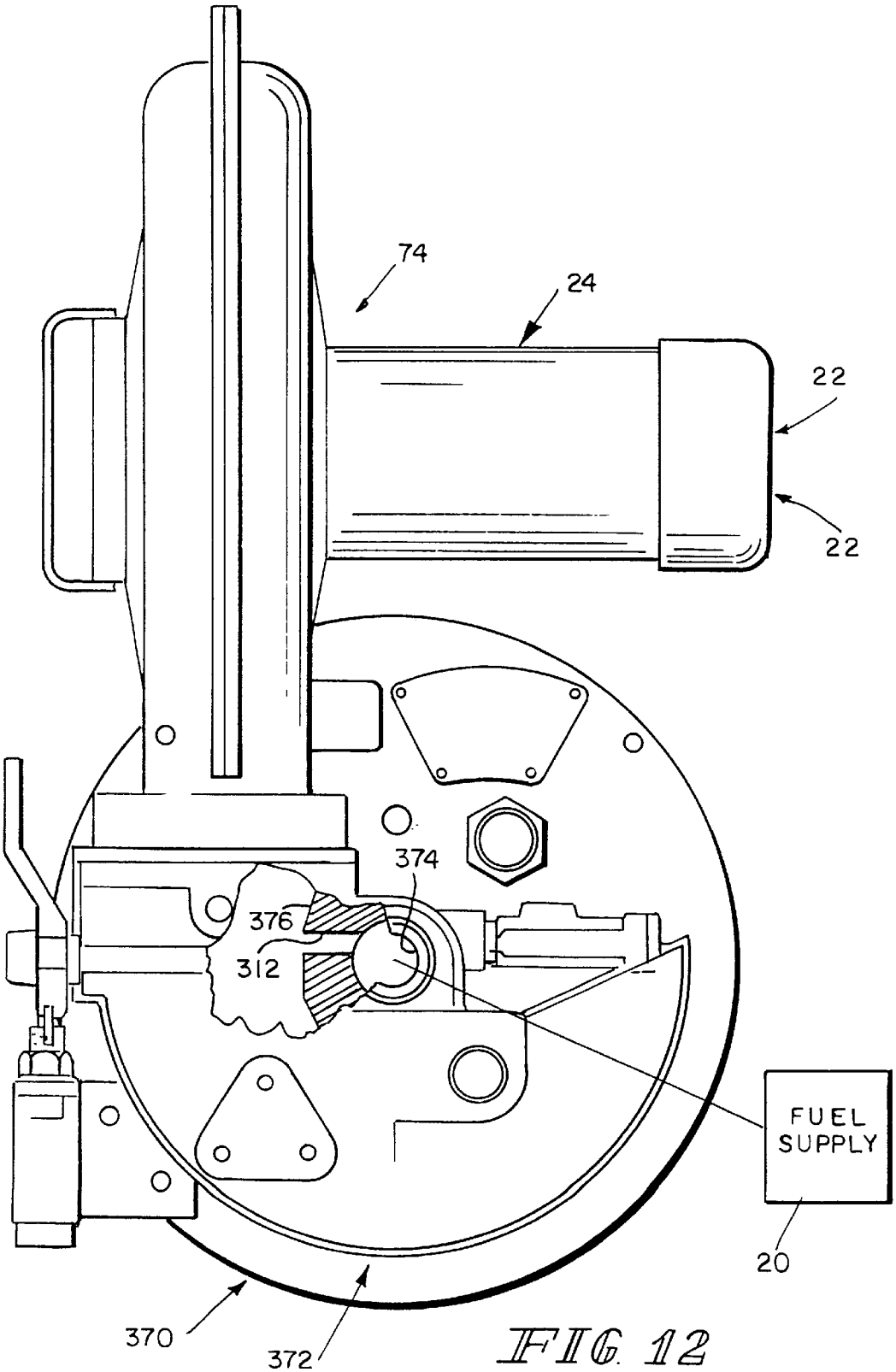
FIG. 12 is a view similar to FIG. 8 of another embodiment of an inlet body of the air-and-fuel supply apparatus in accordance with the present invention showing a burner apparatus coupled to the air-and-fuel supply apparatus and the inlet body including a purge hole extending between a fuel passageway and a combustion air passageway in the inlet body.

Another embodiment of an inlet body of air-and-fuel supply apparatus 370 in accordance with the present invention is illustrated in FIG. 12. Inlet body 372 is coupled to fuel supply 20 and nozzle 16 to permit fuel 18 to pass through inlet body 372 and into fuel-conducting passageway 40 of nozzle 16. Inlet body 372 is also coupled to combustion air fan 74. As shown in FIG. 12, inlet body 372 includes a fuel passageway 374 in communication with fuel supply 20 and nozzle 16, a combustion air passageway 376 in communication with combustion air fan 74 and nozzle 16, and a purge hole 312 extending between fuel and combustion air passageways 374, 376. Inlet body purge hole 312 allows a pre-determined amount of air 22 to bleed into fuel passageway 374 for a slight "pre-mix" effect. Air 22 only bleeds into fuel passageway 374 when the air pressure is higher in air passageway 376 than the gas pressure is in fuel passageway 374, (i.e., in a turn-down condition where the amount of fuel 18 flowing into fuel passageway 274 is reduced.) This turn-down condition exists at minimum or near-minimum firing conditions.

Figure 13:
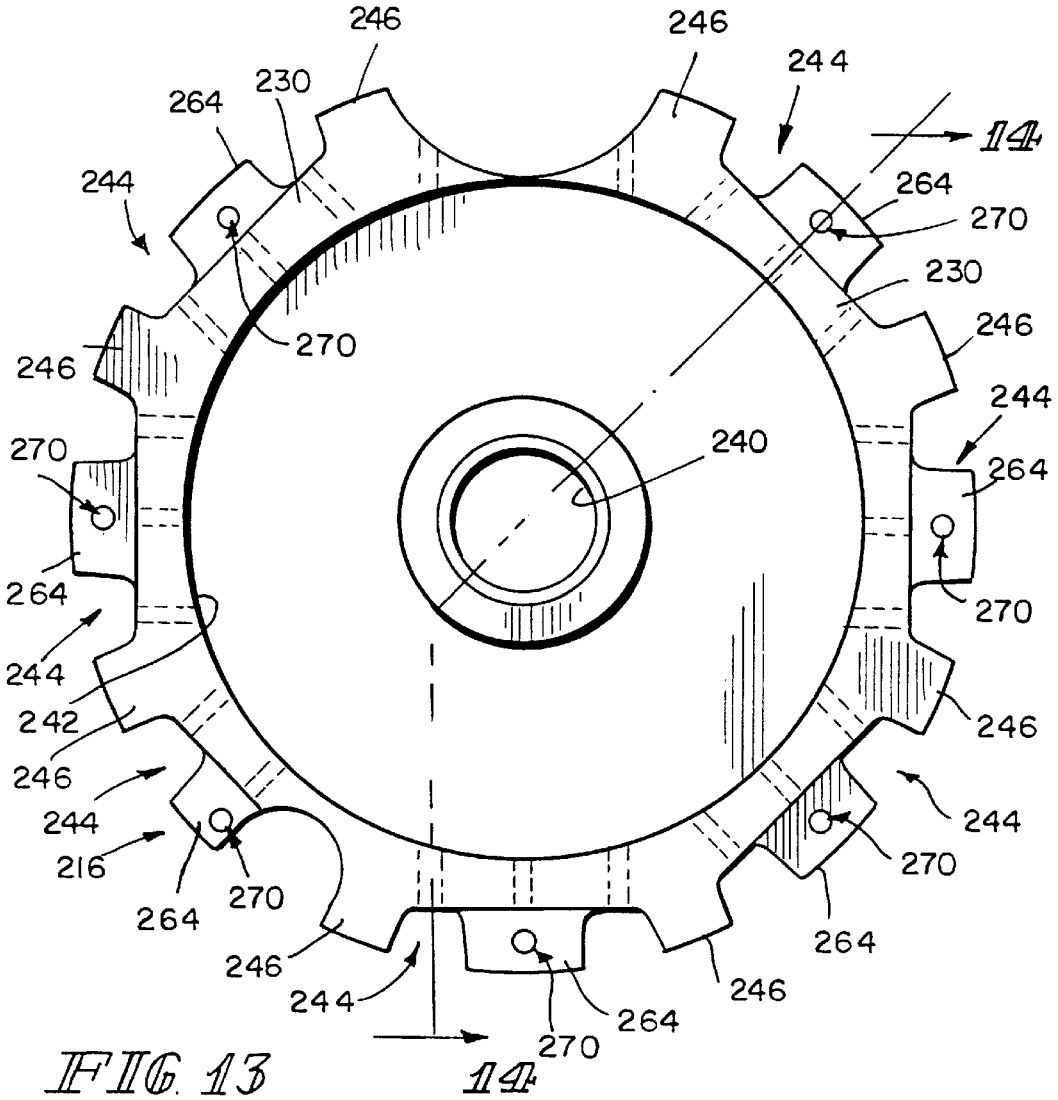
FIG. 13 is a view similar to FIG. 10 of another embodiment of a nozzle for a burner apparatus in accordance with the present invention showing a hole formed through each bluff body.
Figure 14:
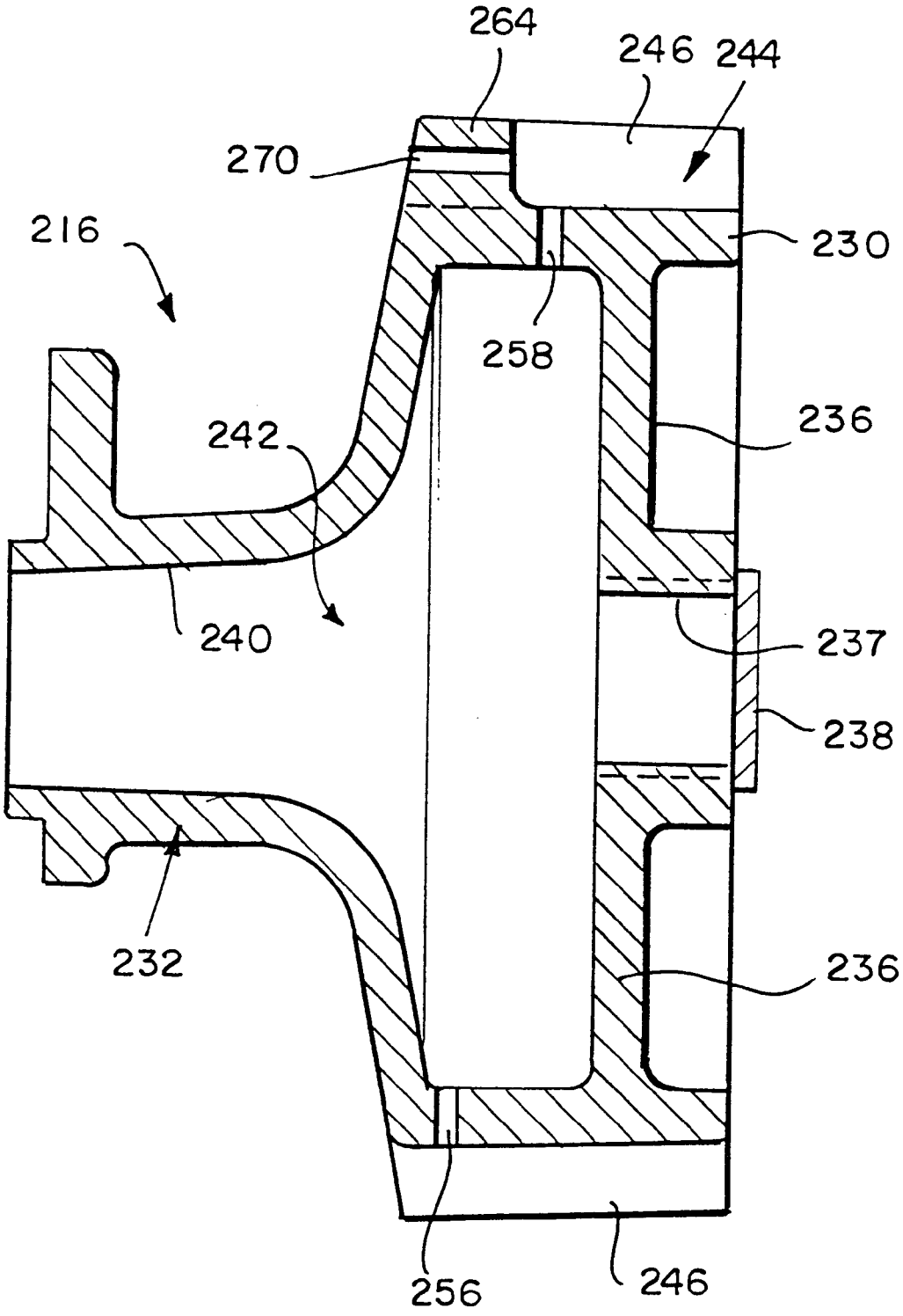
FIG. 14 is sectional view taken along line 14—14 of FIG. 13.

Another embodiment of a nozzle in accordance with the present invention is illustrated in FIGS. 13 and 14. Nozzle 216 includes a body 230, inlet portion 232, and closure portion 236 having an opening 237 covered by plate 238. While plate is illustrated and described, it is understood that a wide variety of blocking mechanisms such as a plug and the like may be used in accordance with the present invention. A fuel-conducting passageway 240 conducts fuel to fuel-distribution chamber 242 for delivery to air-flow cavities 244 defined in part by vanes 246 via main fuel-discharge ports 256 and pilot fuel-discharge ports 258. Bluff-body flame holders 264 are provided in each of the eight air-flow cavities. Each bluff-body flame holder 264 is formed to include a hole 270 extending therethrough. Holes 270 permit the flow of air 22 therethrough.

Although the invention has been described in detail with reference to certain preferred embodiments, variations and modifications exist within the scope and spirit of the invention as described and defined in the following claims.

What is claimed is:

1. A burner apparatus comprising a case formed to include an interior region and a nozzle positioned to lie in the interior region of the case, the nozzle being formed to include a fuel-distribution chamber, the nozzle add the case cooperating to form a series of spaced-apart air-flow cavities in the interior region of the case, the nozzle being formed to include at least one fuel-discharge port aligned with selected air-flow cavities to communicate fuel from the fuel-distribution chamber into air flowing through the selected air-flow cavities to establish a combustible air-and-fuel mixture therein the nozzle including a bluff-body flame holder positioned to lie in at least one of the air-flow cavities.

2. The burner apparatus of claim 1, wherein the case includes an air plenum formed to include an interior air transfer region adapted to communicate air from an air supply to the air-flow cavities and the nozzle includes a funnel-shaped inlet portion positioned to lie in the interior air transfer region to cause air flowing through the interior air transfer region to flow around the funnel-shaped inlet portion of the nozzle to reach the air-flow cavities.

3. The burner apparatus of claim 2, wherein the case further includes a combustion sleeve formed to include a combustion chamber receiving air-and-fuel mixtures discharged from the air flow cavities and a portion of the nozzle is positioned to lie in the combustion chamber.

4. The burner apparatus of claim 3, wherein the air plenum includes a shell defining the interior air transfer region, the interior air transfer region having a first diameter, and the combustion sleeve includes a cylindrical wall having a second diameter being larger than the first diameter and defining the combustion chamber and an annular mounting flange appended to one end of the cylindrical wall and coupled to the shell to place the interior air transfer region in fluid communication with the combustion chamber via the air-flow cavities.

5. The burner apparatus of claim 4, wherein the nozzle includes eight vanes uniformly spaced apart from one another to define eight air-flow cavities.

6. The burner apparatus of claim 3, wherein the air plenum and combustion sleeve cooperate to define an outer boundary wall defining an outer boundary of each air-flow cavity and the nozzle includes an inner boundary wall lying in spaced-apart relation to the outer boundary wall to define the air-flow cavities therebetween and the at least one fuel-discharge port is formed in the inner boundary wall.

7. The burner apparatus of claim 6, wherein the nozzle is formed to include two fuel-discharge ports positioned to lie in spaced-apart relation to one another in the air-flow cavity to place the bluff-body flame holder therebetween.

8. The burner apparatus of claim 6, wherein the nozzle includes a bluff-body flame holder positioned to lie in all but one of the eight air-flow cavities.

9. The apparatus of claim 2, wherein the case further includes a combustion sleeve formed to include a combustion chamber receiving air-and-fuel mixtures discharged from the air-flow cavities and the nozzle is formed to include the air-flow cavities in certain locations to place the interior air transfer region in fluid communication with the combustion chamber via the air-flow cavities and a portion of the nozzle is positioned to lie in the combustion chamber.

10. The apparatus of claim 9, wherein the nozzle includes an annular outer wall formed to include the at least one fuel-discharge port and a plurality of vanes appended to the annular outer wall and arranged to extend radially outwardly from the wall, each pair of adjacent vanes cooperating to define one of the air-flow cavities therebetween, and the bluff-body flame holder is positioned to lie between selected pairs of adjacent vanes cooperating to define the at least one of the air-flow cavities.

11. The apparatus of claim 9, wherein the nozzle includes a body formed to include the fuel-distribution chamber having a first diameter and a closure portion coupled to a downstream end of the body to face toward the combustion chamber formed in the combustion sleeve, the inlet portion being coupled to an upstream end of the body to position the inlet portion in the interior air-transfer region, the inlet portion being adapted to be coupled to a fuel supply to conduct fuel in the nozzle to the fuel-distribution chamber, and the inlet portion having a second diameter larger than the first diameter.

12. The apparatus of claim 9, wherein the nozzle includes a bluff-body flame holder positioned to lie in all but one of the air-flow cavities.

13. The apparatus of claim 9, further comprising an ignitor positioned in the interior air transfer region to extend into one of the air-flow cavities to ignite a combustible air-and-fuel mixture provided therein.

14. The burner apparatus of claim 2, wherein the air plenum further includes a shell defining the interior air-transfer region and an annular interior flange positioned to lie in the interior air-transfer region and formed to include a passageway containing the nozzle and the air-flow cavities.

15. The burner apparatus of claim 14, wherein the annular interior flange has a central axis and each fuel-discharge port formed in the nozzle is arranged to extend along a line that is perpendicular to the central axis of the annular interior flange.

16. The burner apparatus of claim 14, wherein the shell includes an annular outer wall surrounding the annular interior flange and a front plate coupled to the annular interior flange and the annular outer wall and formed to include an air-outlet aperture positioned to lie at an outlet end of the passageway formed in the annular interior flange.

17. The burner apparatus of claim 2, further comprising an ignitor positioned in the one air-flow cavity without a bluff-body flame holder.

18. The burner apparatus of claim 1, wherein the nozzle includes a body formed to include the fuel-distribution chamber, a wall positioned to lie around the fuel-distribution chamber and formed to include at least one fuel-discharge port associated with and coupled to each air-flow cavity, and a plurality of vanes appended to the wall and arranged to extend away from the fuel-distribution chamber to define one of the air-flow cavities between each pair of adjacent vanes.

19. The burner apparatus of claim 18, wherein the wall of the nozzle is formed to include three fuel-discharge ports associated with and coupled to each air-flow cavity.

20. The burner apparatus of claim 19, wherein the three fuel-discharge ports are arranged in a triangular pattern and one of the three fuel-discharge ports is located downstream of the bluff-body flame holder and positioned to lie behind the bluff-body flame holder.

21. The burner apparatus of claim 19, wherein two of the three fuel-discharge ports each have a selected internal diameter and one of the three fuel-discharge ports has an internal diameter smaller than the selected internal diameter.

22. The burner apparatus of claim 19, wherein the bluff-body flame holder is appended to the wall and positioned to lie in a selected air-flow cavity defined between a pair of adjacent vanes, the three fuel-discharge ports formed in the wall in the selected air-flow cavity cooperate to define a space therebetween on the wall, and the bluff-body flame holder is positioned to lie on the wall in the space.

23. The burner apparatus of claim 19, wherein the three fuel-discharge ports associated with a selected air-flow cavity cooperate to define means for supplying a selected volume of fuel from the fuel-distribution chamber to the selected air-flow cavity so that ninety percent of the selected volume is discharged through a first and second of the three fuel-discharge ports and ten percent of the selected volume is discharged through a third of the three fuel-discharge ports.

24. The burner apparatus of claim 18, wherein the wall of the nozzle is formed to include two fuel-discharge ports associated with and coupled to each air-flow cavity and the bluff-body flame holder is positioned to lie between the two fuel-discharge ports in selected air-flow cavities.

25. The burner apparatus of claim 1, wherein the case includes a combustion sleeve having a first diameter and an air plenum coupled to the combustion sleeve, the air plenum including an air inlet having a second diameter and an air outlet aperture having a third diameter, the first and third diameters being larger than the second diameter, the fuel-discharge ports being positioned to discharge fuel toward an annular interior wall of the plenum arranged to lie around the nozzle.

26. The burner apparatus of claim 1, wherein the nozzle further includes a wall formed to include the at least one fuel-discharge port and the bluff-body flame holder is appended to the wall and positioned to lie in one of the air-flow cavities.

27. The burner apparatus of claim 1, wherein the nozzle is formed to include two main fuel-discharge ports associated with and coupled to each air-flow cavity and one pilot fuel-discharge port associated with and coupled to each air-flow cavity, the three ports being sized and selected to cause about ninety percent of the fuel discharged from the fuel-distribution chamber in the nozzle into the air-flow cavities to pass through the main fuel-discharge ports and about ten percent of the fuel discharged from the fuel-distribution chamber in the nozzle into the air-flow cavities to pass through the pilot fuel-discharge ports.

28. The apparatus of claim 1, wherein the bluff-body flame holder is formed to include an aperture therethrough.

29. The apparatus of claim 1, further comprising an air-and-fuel supply apparatus including an inlet body including a passageway to communicate air from an air supply to the nozzle, a fuel passageway to communicate fuel from a fuel supply to the nozzle, and a purge hole extending between fuel and combustion air passageways.

30. The burner apparatus of claim 1, wherein the nozzle includes a bluff-body flame holder positioned to lie in all but one of the air-flow cavities.

31. The burner apparatus of claim 1, wherein the nozzle includes a plurality of vanes extending radially outwardly from the nozzle toward the case, each pair of adjacent vanes cooperating to define one of the air-flow cavities therebetween, the bluff-body flame holder being positioned to lie approximately half way between the pair of adjacent vanes cooperating to define the at least one air-flow cavity on which the bluff-body flame holder is positioned to lie.

32. The burner apparatus of claim 1, wherein the case includes an air inlet having a first diameter and an air outlet aperture having a second diameter, the first diameter being larger than the second diameter.

33. The burner apparatus of claim 32, wherein the nozzle includes an annular body having a third diameter and an inlet portion coupled to an upstream end of the annular body, the inlet portion being formed to include a fuel-conducting passageway having a fourth diameter, the third diameter being larger than the second diameter.

34. The burner apparatus of claim 1, wherein the at least one fuel-discharge port is located downstream of the bluff-body flame holder and positioned to lie behind the bluff-body flame holder.

35. The burner apparatus of claim 34, wherein the nozzle is formed to include at least three fuel-discharge ports and at least two fuel-discharge ports are circumferentially spaced apart from one another and the bluff-body flame holder.

36. The burner apparatus of claim 34, wherein the nozzle is formed to include at least three fuel-discharge ports and the at least three fuel-discharge ports are arranged in a triangular pattern.

37. A burner apparatus comprising a case formed to include an interior region adapted to receive a flow of air from an air supply and a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, a plurality of vanes appended to the annular outer wall and arranged to lie in circumferentially spaced-apart relation about the annular outer wall to define a plurality of air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, and a bluff-body flame holder positioned to lie in at least one of the air-flow cavities.

38. The burner apparatus of claim 37, wherein the nozzle includes eight vanes uniformly spaced apart about the annular outer wall to define eight air-flow cavities.

39. The burner apparatus of claim 38, wherein a bluff-body flame holder is positioned to lie in seven of the eight air-flow cavities and each bluff-body flame holder is appended to the annular outer wall.

40. The burner apparatus of claim 39, further comprising an ignitor positioned to lie in an air-flow cavity other than the seven of the eight air-flow cavities to ignite a combustible air-and-fuel mixture therein.

41. The burner apparatus of claim 38, wherein at least two fuel-discharge ports are formed in the annular outer wall and positioned to lie between each pair of adjacent vanes.

42. The burner apparatus of claim 41, wherein a bluff-body flame holder is positioned on the annular outer wall to lie between selected pairs of adjacent vanes.

43. The burner apparatus of claim 38, wherein three fuel-discharge ports are formed in the annular outer wall and arranged to lie in a triangular pattern between selected pairs of adjacent vanes.

44. The burner apparatus of claim 37, wherein at least two fuel-discharge ports are formed in the annular outer wall and positioned to lie between each pair of adjacent vanes, the at least two fuel-discharge ports being circumferentially spaced apart from one another.

45. The burner apparatus of claim 44, wherein the bluff-body flame holder is positioned on the annular outer wall between two of the at least two fuel-discharge ports to lie between selected pairs of adjacent vanes.

46. The burner apparatus of claim 44, wherein three fuel-discharge ports are formed in the annular wall and arranged in a triangular pattern.

47. The burner apparatus of claim 46, wherein two of the three fuel-discharge ports each have a selected internal diameter and one of the three fuel-discharge ports has an internal diameter smaller than the selected internal diameter.

48. The burner apparatus of claim 37, wherein the case includes an annular interior wall having a first diameter and positioned to surround the annular outer wall and an interior air transfer region having a second diameter being larger than the first diameter, and the vanes on the annular outer wall to define an outer boundary of the air-flow cavities.

49. The burner apparatus of claim 48, wherein the case includes an air plenum including the annular interior wall and a shell around the annular interior wall and a combustion sleeve coupled to the shell and formed to include a combustion chamber receiving air-and-fuel mixtures discharged from the air-flow cavities, the air plenum defining the first diameter and the combustion sleeve defining the second diameter.

50. The burner apparatus of claim 49, wherein a portion of the nozzle is positioned to lie in the combustion chamber.

51. The burner apparatus of claim 49, wherein the shell includes an annular outer wall surrounding the annular interior wall and a front plate coupled to the annular outer and interior walls and to the combustion sleeve and the front plate is formed to include an air outlet aperture communicating air-and-fuel mixtures from the air-flow cavities to the combustion chamber.

52. The burner apparatus of claim 37, wherein at least one of the fuel-discharge ports is located downstream of the bluff-body flame holder and positioned to lie behind the bluff-body flame holder.

53. The burner apparatus of claim 52, wherein the nozzle is formed to include at least three fuel-discharge ports and at least two fuel-discharge ports are circumferentially spaced apart from one another and the bluff-body flame holder.

54. The burner apparatus of claim 52, wherein the nozzle is formed to include at least three fuel-discharge ports and the at least three fuel-discharge ports are arranged in a triangular pattern.

55. A burner apparatus comprising an air plenum adapted to be coupled to an air supply, a combustion sleeve coupled to the air plenum to define a burner case having an interior region, the combustion sleeve being formed to include a combustion chamber, and a nozzle adapted to be coupled to a fuel supply and positioned to lie within the interior region of the burner case, the nozzle being formed to include a body, a plurality of vanes circumferentially spaced apart around the body, a plurality of fuel-discharge ports positioned to lie between the vanes to communicate fuel conducted from the fuel supply through the body into air from the air supply flowing around the body and between the vanes to produce a plurality of combustible air-and-fuel mixtures located between the vanes and discharged into the combustion chamber, and a bluff-body flame holder positioned to lie between a selected pair of vanes.

56. The burner apparatus of claim 55, wherein at least one of the plurality of fuel-discharge ports is located downstream of the bluff-body flame holder and positioned to lie behind the bluff-body flame holder.

57. The burner apparatus of claim 56, wherein the nozzle is formed to include at least three fuel-discharge ports and at least two fuel-discharge ports are circumferentially spaced apart from one another and the bluff-body flame holder.

58. The burner apparatus of claim 56, wherein the nozzle is formed to include at least three fuel-discharge ports and the at least three fuel-discharge ports are arranged in a triangular pattern.

59. A burner apparatus comprising a case formed to include an interior region and a nozzle positioned to lie in the interior region of the case, the nozzle being formed to include a fuel-distribution chamber, the nozzle and the case cooperating to form a series of spaced-apart air-flow cavities in the interior region of the case, the nozzle being formed to include at least one fuel-discharge port aligned with selected air-flow cavities to communicate fuel from the fuel-distribution chamber into air flowing through the selected air flow cavities to establish a combustible air-and-fuel mixture therein, the nozzle being formed to include two main fuel-discharge ports associated with and coupled to each air-flow cavity and one pilot fuel-discharge port associated with and coupled to each air-flow cavity, the three ports being sized and selected to cause about ninety percent of the fuel discharged from the fuel-distribution chamber in the nozzle into the air-flow cavities to pass through the main fuel-discharge ports and about ten percent of the fuel discharged from the fuel-distribution chamber in the nozzle into the air-flow cavities to pass through the pilot fuel-discharge ports.

60. The burner apparatus of claim 59, wherein the nozzle further includes a bluff-body flame holder positioned to lie in at least one of the air-flow cavities.

61. The burner apparatus of claim 60, wherein the pilot fuel-discharge port is located downstream of the bluff-body flame holder and positioned to lie behind the bluff-body flame holder.

62. The burner apparatus of claim 61, wherein the main fuel-discharge ports are circumferentially spaced apart from one another and the bluff-body flame holder.

63. The burner apparatus of claim 61, wherein the three ports are arranged in a triangular pattern.

64. A burner apparatus comprising a case formed to include an interior region adapted to receive a flow of air from an air supply and a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, eight vanes appended to the annular outer wall and arranged to lie in circumferentially spaced-apart relation about the annular outer wall to define eight air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, and a bluff-body flame holder positioned to lie in seven of the eight air-flow cavities each bluff-body flame holder being appended to the annular outer wall.

65. The burner apparatus of claim 64, wherein one of the eight air-flow cavities is without a bluff-body flame holder and further comprising an ignitor positioned to lie in the air-flow cavity without a bluff-body flame holder to ignite a combustible air-and-fuel mixture therein.

66. A burner apparatus comprising a case formed to include an interior region adapted to receive a flow of air from an air supply a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, and eight vanes appended to the annular outer wall and arranged to lie in circumferentially spaced-apart relation about the annular outer wall to define eight air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, wherein at least two fuel-discharge ports are formed in the annular outer wall and positioned to lie between each pair of adjacent vanes, and a bluff-body flame holder positioned on the annular outer wall to lie between selected pairs of adjacent vanes.

67. A burner apparatus comprising a case formed to include an interior region adapted to receive a flow of air from an air supply and a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, and eight vanes appended to the annular outer wall and arranged to lie in circumferentially spaced-apart relation about the annular outer wall to define eight air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, wherein three fuel-discharge ports are formed in the annular outer wall and arranged to lie in a triangular pattern between selected pairs of adjacent vanes.

68. A burner apparatus comprising a case formed to include an interior region adapted to receive a flow of air from an air supply, a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, and eight vanes appended to the annular outer wall and arranged to lie in circumferentially spaced-apart relation about the annular outer wall to define eight air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, wherein at least two fuel-discharge ports are formed in the annular outlet wall and positioned to lie between each pair of adjacent vanes, and a bluff-body flame holder positioned on the annular outer wall between two of the at least two fuel-discharge ports to lie between selected pairs of adjacent vanes.

69. A burner apparatus comprising a case formed to include an interior region adapted to receive a flow of air from an air supply and a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, and eight vanes appended to the annular outer wall and arranged to lie in circumferentially spaced-apart relation about the annular outer wall to define eight air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, wherein three fuel-discharge ports are formed in the annular outer wall and arranged in a triangular pattern and at least two fuel-discharge ports are positioned to lie between each pair of adjacent vanes.

70. The burner apparatus of claim 69, wherein two of the three fuel-discharge ports each have a selected internal diameter and one of the three fuel-discharge ports has an internal diameter smaller than the selected internal diameter.

71. A burner apparatus comprising a case formed to include an interior region adapted to receive a flow of air from an air supply and a nozzle positioned to lie in the interior region of the case, the nozzle including a fuel-distribution chamber adapted to receive fuel from a fuel supply, an annular outer wall formed to include fuel-discharge ports coupled in fluid communication to the fuel-distribution chamber, and eight vanes appended to the annular outer wall and arranged to lie in circumferentially spaced-apart relation about the annular outer wall to define eight air-flow cavities located between pairs of adjacent vanes to receive air flowing through the interior region of the casing and fuel discharging from the fuel-distribution chamber through the fuel-discharge ports to establish combustible air-and-fuel mixtures in the air-flow cavities, the nozzle further including a bluff-body flame holder positioned to lie in at least one of the air-flow cavities.

72. The burner apparatus of claim 71, wherein one of the fuel-discharge ports is located downstream of the bluff-body flame holder and positioned to lie behind the bluff-body flame holder.

73. The burner apparatus of claim 72, wherein the nozzle is formed to include at least three fuel-discharge ports and at least two fuel-discharge ports are circumferentially spaced apart from one another and the bluff-body flame holder.

74. The burner apparatus of claim 72, wherein the nozzle is formed to include at least three fuel-discharge ports and the three fuel-discharge ports are arranged in a triangular pattern.

* * * * *